United States Patent [19]

Clark

[11] Patent Number: 4,819,384

[45] Date of Patent: Apr. 11, 1989

[54] OFFHAND TOOLING ATTACHMENT FOR RADIUS GRINDING

[76] Inventor: Wayne R. Clark, 1455 S. State, Space 249, Hemet, Calif. 92343

[21] Appl. No.: 105,551

[22] Filed: Oct. 5, 1987

[51] Int. Cl.[4] ..... B24B 19/00

[52] U.S. Cl. ..... 51/218 R; 51/218 A

[58] Field of Search ..... 51/218 R, 218 A, 220, 51/221 R, 216 A, 217 A, 102, 230; 82/32, 38 R; 269/58, 71, 258, 268, 73, 303, 304, 307, 315

[56] References Cited

U.S. PATENT DOCUMENTS

| | | | |
|---|---|---|---|
| 1,420,286 | 6/1922 | Rintoul | 51/230 |
| 2,785,709 | 3/1957 | Shepp | 269/58 |
| 4,502,457 | 3/1985 | Marron | 51/218 A |

FOREIGN PATENT DOCUMENTS

| | | | |
|---|---|---|---|
| 0412313 | 9/1945 | Italy | 269/71 |

*Primary Examiner*—Frederick R. Schmidt
*Assistant Examiner*—Lawrence Cruz
*Attorney, Agent, or Firm*—Stetina and Brunda

[57] ABSTRACT

A fixture for reproducibly pivoting a workpiece about a specific point which lies beyond the physical confines of the fixture itself, such fixture being characterized by at least two platform members vertically stacked in horizontal juxtaposition and having a generally arcuate guide rail/guide track arrangement disposed therebetween. Such arcuate guide rail/guide track arrangement enables pivotal manipulation of the upper platform member with respect to the lower platform member about a pivot point which lies beyond the perimeter of either platform member, thereby permit precise convex and concave radius grinding of a workpiece. The workpiece is held on top of the upper platform member and there are provided additional means for precisely adjusting the lateral, front-to-back and angular position of the workpiece on the upper surface of the upper platform member. Additional platform members may be slidably disposed beneath the lower platform member so as to provide for additional adjustability of the fixture.

19 Claims, 2 Drawing Sheets

OFFHAND TOOLING ATTACHMENT FOR RADIUS GRINDING

BACKGROUND OF THE INVENTION

This application pertains to the art of machine tooling and more particularly to the art of radius grinding of various workpieces such as lathe tools and the like.

The invention may be particularly applicable to radius grinding of small parts such as lathe tools and will be described with particular reference thereto, although it will be appreciated that the invention has broader applications, including any machining step wherein pivotal manipulation of a workpiece is desired.

The machining of various parts has heretofore required grinding or other machining of the parts to form various radial machine surfaces, such as radiused edges, corners, and the like. Frequently, the machining of relatively small workpiecse requires adherence to very closer tolerances, such that, where a radial surface is called for, the machining of such surface must be carried out with extreme care, so as to adhere to the prescribed tolerances. Even small errors in positioning of the workpiece during machining may lead to a final product which is outside the prescribed tolerances and must, therefore, be discarded. Such errors may be extremely costly, especially with parts which have been subjected to multiple machining steps prior to the step where the error is made. Indeed, such errors are costly not only in terms of material costs, but in view of the extensive labor involved in the preparation of such parts.

In order to minimize the likelihood of error in preparing machine tools to specific tolerances, it has heretofore been common practice to utilize various fixtures, jibs, manipulators, vices, and other holding devices to precisly position the part during the machining process. Such positioning devices frequently incorporate and employ a vice or clamp-like mechanism to hold the workpiece firmly in place. Alternatively, such positioning devices may be in the form of "offhand" fixtures which provide a means of precisely positioning an individual workpiece without requiring tightening of a vice or other rigid clamping of the workpiece to the fixture. Fixtures of this type often employ a positioning block or straight edge which may be precisely adjusted. A workpiece may then be held against the preadjusted guide block or straight edge during machining. Such "offhand" positioning devices permit relatively rapid removal and replacement of one workpiece by another without the necessity of losening/tightening rigid clamping mechanisms and the like.

The machining of close-tolerance radial surfaces is frequently accomplished by positioning a workpiece in a rotationally adjustable fixture, such that the workpiece may be pivoted about a specific point. The workpiece is then placed in contact with a grinding wheel or other tooling surface and subsequently pivoted about a center point so as to result in grinding or machining of the workpiece to form the desired radius thereon. However, in the prior art devices, the centerpoint around which the workpiece is pivoted necessarily lies within the confines of the fixture itself. Since the workpiece will normally be positioned so as to extend over or beyond the edge of a given fixture in order to provide for contact of the workpiece with the machining tool, mechanisms which pivot about an internally located pivot point may be less than optimal when a close tolerance radius is required at the extreme tip of the workpiece.

Thus, there exists a substantial need in the art for a fixture or other device which provides a means of pivoting a workpiece about a point which lies beyond the confines of the fixture device itself.

SUMMARY OF THE PRESENT INVENTION

The present invention specifically addresses and alleviates the above-referenced deficiencies of the prior art by providing a new and improved device for reproducibly pivoting a workpiece about a specific point which lies beyond the confines of the fixture device itself. By providing a means for pivoting a workpiece about such "phantom point", the invention enables the machining of small, convex and concave close tolerance radial shapes in a manner not heretofore achievable.

In accordance with the present invention there is provided a fixture for holding and rotating a workpiece about a specific point, such fixture comprising at least two platform members. A lower platform member is provided with an arcuate or semicircular guide track positioned on the upper surface thereof with the ends of such arcuate or semicircular guide track extending to and terminating at an edge of the lower platform member. An upper platform member is provided with a correspondingly positioned arcuate or semicircular guide rail emanating downwardly therefrom such that the guide rail may be slidably positioned within the guide track of the lower platform member, thereby permitting pivotal movement of the upper platform member with respect to the lower platform member.

In accordance with a more limited aspect of the present invention there is provided a fixture of the foregoing character wherein the arcuate or semicircular guide track of the lower platform member is a generally T-shaped trough while the guide rail of the upper platform member is, likewise, complimentary T-shaped, such that the guide rail will remain locked within the guide track during pivotal movement of the device, thereby preventing unintentional separation of the upper platform member from the lower platform member.

Yet another aspect of the present invention provides a fixture of the foregoing character wherein the upper platform member is provided with an additional lateral positioning means for lateral manipulation and holding of the workpiece during machining. Such lateral positioning means may comprise a side-to-side guide track within the upper surface of the upper platform member and a corresponding guide block or clamping device having a side-to-side guide track emanating downwardly therefrom, such that the guide block or clamping device may be moved from side to side on the upper platform of the fixture.

In accordance with yet another aspect of the present invention, there may be provided a fixture of the foregoing character including an additional means for angular positioning of the workpiece with respect to the fixture, said means for angular positioning of the workpiece comprising a straight edge or clamping device adjustably mounted on the upper platform member, and having a protractor or other measuring means attached thereto for gauging specific angular placement of the workpiece during machining. It should be appreciated that the means for angular positioning of the workpiece and the means for side-to-side or lateral positioning of the workpiece referred to above may be incorporated into a single mechanism positioned on top of the upper platform of the fixture and whereby the workpiece may be manipulated in both a side-to-side and angular manner.

According to a still further aspect of the present invention, the foregoing fixture device is provided with an additional means for adjusting the forward-backward position of the workpiece with respect to the upper platform of the fixture. Such means for adjusting the forward-backward positioning of the workpiece may comprise a micrometer or any other graduated adjustment instrument having a readable scale thereon to enable reproducible positioning of a given type and size of workpiece.

Further in accordance with the present invention the fixture of the foregoing character is further provided with one or more additional platform members in horizontal juxtaposition beneath the above-referred to lower platform member. Each such additional platform member is adjustable in some manner so as to provide for additional angular, attitudinal, lateral, front-to-back, and other positioning adjustments of the workpiece during machining.

The principal object of the invention is to provide a convenient and reproducible means for pivotally moving a workpiece about a point which is located beyond the physical confines of the fixture within which the workpiece is held or positioned.

A further object of the present invention is to provide a single device for conveniently holding and manipulating a workpiece during machining thereof, including side-to-side, forward-backward, and various angular manipulations-and/or positioning of the workpiece, in addition to the herein-described novel means for rotating and/or pivoting of the workiece about a point which is located beyond the physical confines of the fixture itself.

Additional objects and advantages of the invention will be apparent from the following detailed description of a preferred embodiment thereof and from the accompanying drawings which form a part hereof.

DESCRIPTION OF THE PREFERRED EMBODIMENT

Figure 1:
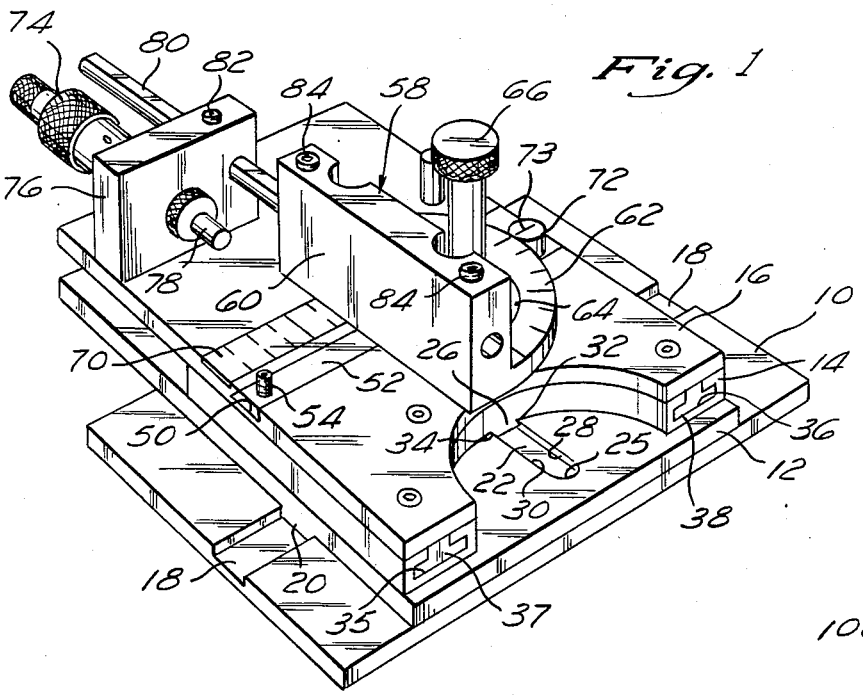
FIG. 1 is a perspective view of a fixture comprising the invention.

Referring now to the drawings wherein the showing is for the purpose of illustrating a preferred embodiment of the invention only and not for the purposes of limiting same, FIG. 1 shows a fixture device of the present invention comprising first 10, second 12, third 14, and fourth 16 platform or plate members positioned in close vertically stacked horizontal juxtaposition to one another. First platform member 10 is provided with a first guide track 18 which runs laterally from side-to-side of first platform 10. Second platform 12 is provided with an analogous straight guide rail member emanating downwardly therefrom and extending from one side of second platform member 12 to the other side of second platform member 12 so as to fit directly and slidably within guide member 18 of first platform member 10. Accordingly, second platform 12 may be slidably manipulated laterally from side-to-side with respect to first platform member 10.

Second platform member 12 is further provided with a second guide track 22 running generally from the front of platform member 12 to the rear of platform member 12. Second guide track 22 does not, however, extend all the way to the front edge of second platform member 12, but terminates a short distance from such front edge. The front terminus 25 of second guide track 22 is in the form of a blunt U-shape.

Third platform member 14 is provided with an analogous second guide rail member 26 emanating downwardly therefrom and extending generally from the front of third platform member 14 to the rear of third platform member 14. Second guide track 22 is provided with slightly angularly undercut sidewalls 28,30 while guide rail member 26 is provided correspondingly angularly overcut sidewalls 32,34 so as to lock guide rail 26 within a second guide track 22 while permitting said guide rail 26 to remain easily slidable therewithin. The blunt terminus 25 of second guide track 24 limits the forward adjustability of third platform member 14 with respect to second platform member 12.

The upper surface of third platform member 14 is provided with an arcuate guide track. Such arcuate guide track extends generally inward from the front edge of third platform member 14 with both ends 34 and 36 of such guide track terminating at the front edge of third platform 14. Fourth platform 16 is provided with an analogous arcuate guide rail emanating downwardly therefrom and extending in a corresponding, generally semicircular pattern. Both ends 34,38 of such guide rail are shown to be co-terminal with the front openings 34 and 36 of the corresponding arcuate guide track located in the upper surface of third platform 14. Of course, as fourth platform 16 is rotationally manipulated, the ends 34,38 of the semicircular guide rail will no longer remain co-terminal with the front openings 34,36 of the corresponding guide track of third platform 14.

The upper surface of platform 16 forms the surface upon which the workpiece is held during machining. The upper surface of platform 16 is provided with a single guide track 50 which runs the entire width of platform 16. A corresponding independent guide rail 52 is slidably inserted within guide track 50. Independent guide rail 52 is provided with a set screw 54 extending therethrough and which, when tightened, serves to lock the guide rail 52 in place and prevent side-to-side movement of guide rail 52 within guide track 50. A guide block 58 is provided with a flat vertical surface 60 against which the workpiece may be positioned and firmly held. Guide block 58, on its opposite side, is provided with a perpendicularly extending protractor base 62 having an arcuate slit 64 which extends vertically therethrough. Guide rail 52 is further provided with a threaded vertical mounting post which is firmly attached to and extends upwardly from guide rail 52 and through arcuate slit 64 of protractor-base 62. An internally threaded set screw 66 is then threaded onto the upstanding protruberance such that, when tightened, internally threaded set screw 66 will firmly hold the protractor 62 of guide block 68 in a preset position, thereby insuring that guide block 58 remains at its preset angle.

Additionally, the precise lateral position of the workpiece may be gauged or preset by lateral linear scale 70 while the angular positioning of the workpiece may, of course, be gauged or preset by protractor 62. A raised, disc-shaped body 72 is firmly attached to one end of guide rail 50, and is provided with a single scored marking 73 which is used as a reference point in reading protractor 62. The forward advancement of the workpiece may be finely adjusted by micrometer 74 which extends through block 76 and is provided with micrometer adjustment probe 78. Micrometer adjustment probe 78 advances and retracts in response to adjustment of micrometer 74. Block 76 is further provided with a side aperture through which shaft 80 is passed, allowing block 76 to be slidably advanced or retracted on shaft 80. The opposite end of shaft 80 is inserted into a horizontal aperture of vertical guide block 58 and is secured in place by set screw 84. When set screw 82 is loosened, block 76 and attendant micrometer adjustment 74 may be advanced or retracted on shaft 80 to a desired position, at which point set screw 82 may be retightened to prevent subsequent movement of block 76 on shaft 80. Such arrangement provides for additional coarse adjustability of the forward position of the workpiece, beyond the scope of the adjustment which would be provided solely by micrometer adjustment 74.

Figure 2:
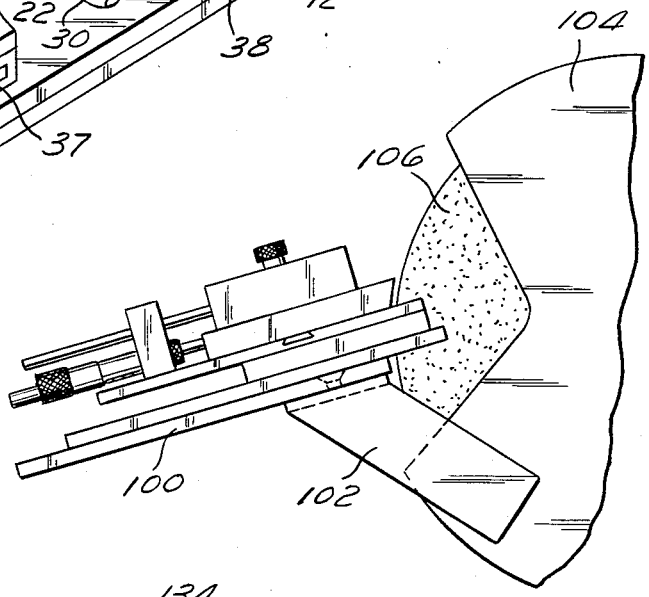
FIG. 2 is a side elevational view showing the fixture of the present invention mounted upon a grinding machine and in relation to a rotational grinding wheel.

The fixture of the present invention is particularly applicable to the art of rotary grinding of small workpieces, such as lathe tools and the like. Accordingly, FIG. 2 shows a fixture 100 of the present invention as described in FIG. 1 and mounted by means of a bracket 102 on guard plate 104 of a rotary grinder grinding wheel 106.

Figure 3:
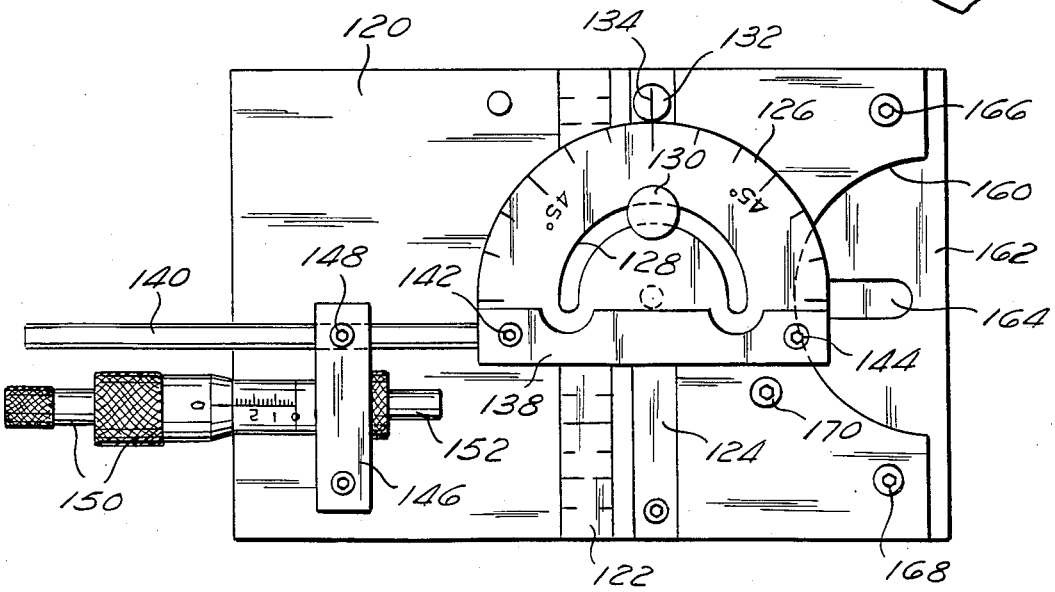
FIG. 3 is a plan view of a fixture comprising the present invention.

The arrangement of the positioning apparatus on the upper platform member of the present invention may be appreciated from the plan view of FIG. 3. As shown on FIG. 3, upper platform member 120 is provided with a linear scale 122 extending the full width of upper platform member 120 and in close proximity to guide rail 124. Protractor 126 is attached to guide rail 124 and may be slidably manipulated along arcuate slit 128. When the desired position of protector 126 has been reached, set screw 130 may be tightened hereby preventing further movement of protractor 126. Raised disc 132 is firmly attached to guide rail 124 and is provided with a single hashmark 134 which may be used as a reference point in reading protractor 126 along with arcuate slit 126. Protractor 126 is perpendicularly connected to vertical guide block 138. Shaft 140 is advanced into vertical guide block 138 and held in position by set screws 142 and 144. Shaft 140 further passes through block 146 permitting block 146 to be slidably moved along shaft 140. Block 146 is provided with a set screw 148 which, when tightened, prevents subsequent movement of block 146 on shaft 140. Micrometer adjustment 150 is also mounted on block 146 with micrometer adjustment probe 152 extending from the opposite side of block 146 so as to abut a workpiece positioned against vertical guide block 138. The forward advancement of such workpiece may thus be coarsely adjusted by movement of block 146 along shaft 140 and may be more precisely adjusted by movement of micrometer adjustments 150 and 151. A portion of top platform 120 and an underlying second platform is cut away to form an arcuate notch 160 exposing the upper surface of an additional underlying platform in the upper surface of underlying platform 162, and the terminal portion of guide track 164. Placement screws 166, 168, and 170 extend through upper plate 120 and provide a means of attachment for the arcuate guide rail which extends downwardly therefrom and enables the inventive pivotal movement of upper plate 120 about a point which lies beyond the physical confines of the fixture itself.

Figure 4:
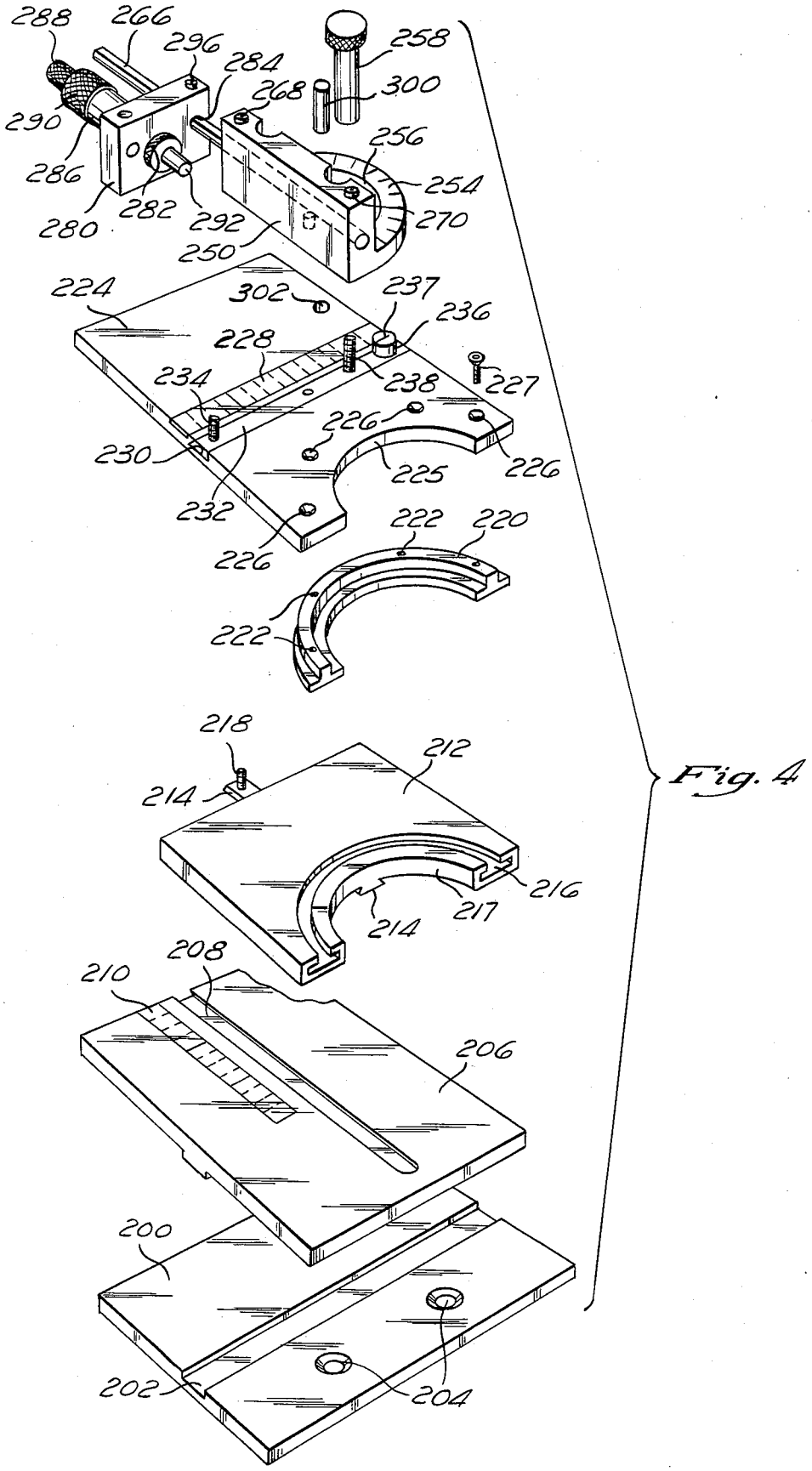
FIG. 4 is an exploded perspective view of the fixture comprising the invention.

Detailed aspects of the individual structural elements of the inventive fixture may be appreciated from the exploded perspective view of FIG. 4, wherein first platform member 200 is provided with a first guide track 202 and chamfered apertures 204. Mounting bolts may be passed through apertures 204 to mount the fixture on an underlying structure.

Second platform member 206 is provided with a guide rail emanating from the bottom side thereof which fits slidably in guide track 202 and permits side-to-side movement of second platform 206 relative to first platform 200. Second platform 206 is further povided with a second guide track 208 on the upper surface thereof. Second guide track 208 runs generally from the rear edge of second platform 206 to a point near the front edge of second platform 206. Guide track 208 terminates at its foremost point in a blunt, U-shaped pattern. A linear scale 210 is also located on the upper surface of the second platform 206 and provides a means for gauging the linear position of third platform 212 with respect to second platform 206. Third platform 212 is further provided with a second guide rail 214 emanating downwardly therefrom and running from the front to rear of third platform 212. Second guide rail 214 terminates flush with the front edge of third platform 212 and is located centrally, such that its front edge terminates at the innermost reaches of an arcuate notch 217 which exists in the front portion of third platform 212. Guide rail 214 extends slightly beyond the rear edge of third platform 212 and is provided with a set screw 218. Guide rail 214 is analogous in configuration to guide track 208 such that guide rail 214 may be slidably inserted therewithin. Thus, third platform 212 may be adjusted in a forward-backward manner with respect to second platform 206. The precise point of adjustment of platform 212 is gauged by and may be read from linear scale 210. Platform 212 may then be fixed in position by tightening set screw 218 located on guide rail 214. The upper surface of third platform 212 is provided with semicircular guide rail 216 which is a T-shaped trough, the ends of which terminally abut and are open to the front edge of third platform 212. The area of platform 212 which is within semicircular guide rail 216 is cut away, forming an arcuate notch 217 within the front portion of platform 212. Arcuate guide rail 220 is provided with a shape which is analogous to guide track 216 such that arcuate guide rail 220 may be inserted and slidably rotated within guide track 216. Arcuate guide rail 220 is provided with a number of tapped holes 222 in the upper surface thereof. Fourth platform member 224 is provided with apertures 226 which correspond with tapped holes 222 of guide rail 220. Mounting screws 227 are inserted through apertures 226 and threaded into guide rail 220 so as to mount guide rail 220 on the lower surface of third platform 224. A portion of fourth platform 224 which lies within the radius of arcuate guide track 220 is cut away forming an arcuate notch 225 corresponding with the arcuate notch 217 of third platform member 212. Fourth platform member 224 is further provided with a guide track 230 running from side to side in the upper surface thereof and the linear scale 228 positioned next to guide track 230. An independent guide rail 234 is slidably disposed within guide track 230. Independent guide rail 234 is provided with a cylindrical mounting post 238 extending upwardly therefrom and a disc-shaped indicator body 236 affixed thereto. The disc-shaped indicator body is provided with a scored marking 237 which is used as a reference point in reading protractor 126. Also, a set screw 234 is positioned through a threaded aperture extending through guide rail 232, such that when set screw 234 is tightened, guide rail 232 will be held in a preset position within guide track 230.

A positioning block 250 is provided with an perpendicularly mounted protractor 254 having an arcuate slit 256 therethrough. The perpendicular mounting post 238 is passed through arcuate slit 256 and internally threaded by set screw 258 and is tightened, thereby holding guide block 250 in place on the upper surface of platform 224. The angular position of guide block 250 may be adjusted by loosening set screw 258 and repositioning mounting post 238 within arcuate slit 256. Mounting shaft 266 is passed through a hollow passage running longitudinally through positioning block 250. Set screws 268 and 270 are tightened to hold shaft 266 in position within guide block 250.

The forward advancement of the workpiece is controlled by a related assembly designated for precise and reproducible positioning of workieces during machining, namely grinding. A second block 280 is provided with apertures 282 and 284 extending therethrough. A micrometer 286 having fine 288 and couarse 290 adjustments is positioned through aperture 282 and controls the inward advancement of adjustment probe 292. Second block 280 is slidably mounted on shaft 266 by passing shaft 266 through aperture 284. The advancement of block 280 on shaft 266 is held in position by set screw 296. Thus, the forward positioning of the workpiece may be roughly adjusted or preset by advancing or retracting block 280 on shaft 266, and further adjusted or preset by adjusting micrometer 286. Such means of coarse and fine adjustment provides for precisely positioning of the workpiece.

A locking pin 300 may be inserted through aperture 302 of fourth platform member 224. When in place, locking pin 300 will extend through fourth platform member 224 and will engage blind hole in upper surface of second platform member 206, thereby preventing inadvertent pivotal movement of fourth platform member 224 with respect to third platform member 212. When locking pin 300 is removed, fourth platform member 224 is free to be completely rotated via arcuate guide rail 222 and arcuate guide track 216.

In the normal course of operation, the fixture of the present invention is mounted in close proximity to the rotating grinding wheel of a grinding machine. The lateral positioning of the fixture is generally initially set by sliding the first additional platform member from side-to-side with respect to the second additional platform member. Likewise, the front-to-back position of the fixture is generally initially set by sliding the lower platform member forward or backward with respect to the first additional platform member.

After the initial positioning of the fixture, more precise settings are achieved by first adjusting the lateral position of the positioning block on the upper platform of the fixture by moving the lateral guide rail within the lateral guide track and tightening it in place. Additionally, the angular position of the lathe tool is set by positioning the protractor at a specific preset position and tightening it in place. In so doing, the tip of the lathe tool will be positioned near the surface of the grinding wheel. To begin grinding of the lathe tool, the micrometer is slightly advanced so as to bring the desired point of the tip of the lathe tool into contact with the grinding wheel. Subsequently, the retaining pin holding the upper platform in place is removed and the upper platform member is manipulated in a pivotal manner utilizing the above-described arcuate guide rail and arcuate guide track arrangement. In so doing, the tip of the lathe tool is tightly rotated about a specific projected phantom pivot point, thereby accomplishing the desired grinding of a small diameter radius at the tip of the tool. Thus, the fixture of the present invention is particularly useful in grinding small diameter radiuses such as radial tool corners and the like.

After the tip of the lathe tool has been ground to the desired small radius, the upper platform member is rotated back to its initial position, the locking pin is reinserted, and the micrometer is slightly backed off to remove the tip of the lathe tool from near contact with the grinding wheel. The finished lathe tool is then removed from the fixture. Another lathe tool may then be placed in position and the foregoing procedure repeated, thereby accomplishing reproducible, consecutive grinding of a number of lathe tools, using the offhand positioning fixture of the present invention.

The invention has been described herein with reference to a preferred embodiment thereof. Obviously, modifications and alterations will occur to those skilled in the art upon reading and understanding the specification. It is my intention to include all such modifications and alterations insofar as they come within the scope of the appended claims or the equivalents thereof.

What is claimed is:

1. A fixture for pivotal manipulation of a workpiece, said fixture comprising:

an upper platform member having upper and lower surfaces and a plurality of outer edges defining the outer periphery thereof, said upper platform member being provided with an arcuate guide rail having first and second ends, said arcuate guide rail being attached to said lower surface of the upper platform member and a means for positioning a workpiece attached to said upper surface thereof, said means for positioning a workpiece being operative to position said workpiece such that a portion of the workpiece extends outside of the outer periphery of the upper platform member; and a lower platform member having upper and lower surfaces and a plurality of outer edges defining the outer periphery thereof, said lower platform member being provided with an arcuate guide track positioned on said upper surface thereof, said guide track being analogous in configuration to said guide rail with at least one end thereof being terminally flush with and open to an edge of said lower platform member;

said upper and lower platform members being closely juxtapositioned such that said arcuate guide rail is slidably disposed within said arcuate guide track, thereby permitting partial rotational movement of said upper platform member with respect to said lower platform member such that a portion of said guide rail may emerge from and extend out of the terminally open end of said guide track;

said partial rotational movement of said upper platform member with respect to said lower platform member being effective to pivot said workpiece about a pivot point lying beyond the outer periphery of the upper platform member.

2. The fixture of claim 1 wherein said guide rail is generally T-shaped and said guide track is also generally T-shaped such that said guide rail may be slidably disposed yet vertically locked within said guide track or in pivotal movement of the fixture, thereby preventing unintentional separation of said upper platform member from said lower platform member.

3. The fixture of claim 1 wherein said means for positioning a workpiece comprises an adjustable positioning block for off-hand machining of said workpiece.

4. The fixture of claim 3 wherein said positioning block is provided with a protractor adjustment for adjusting the angle of said positioning block relative to said fixture.

5. The fixture of claim 3 including a means for adjusting the forward advancement of the workpiece relative to said fixture.

6. The fixture of claim 5 wherein said means for adjusting the forward position of said workpiece comprises a micrometer.

7. The fixture of claim 5 wherein said means for adjusting the forward advancement of said workpiece comprises a separate positioning member slidably mounted upon a shaft such that said second positioning member may be slidably advanced to abut said workpiece and to hold said workpiece in a predetermined forward position.

8. The fixture of claim 1 including a means for adjusting lateral position of said positioning block relative to said fixture.

9. The fixture of claim 8 wherein said means for adjusting the lateral position of said positioning block comprises a lateral guide track running generally from side-to-side on said upper surface of said upper platform, said lateral guide track being further provided with a lateral guide rail slidably disposed therein, said lateral guide rail being firmly attached to said positioning block.

10. The fixture of claim 1 wherein an arcuate notch has been cut away from said upper and said lower platform members, said arcuate notch being generally circumferentially surrounded by said arcuate guide track and said arcuate guide rail.

11. The fixture of claim 1 wherein said means for positioning a workpiece may be adjusted so as to cause a portion of said workpiece to extend beyond the physical parameter of said upper platform member.

12. The fixture of claim 1 including;

a first additional platform member juxtapositioned beneath said lower platform member, said first additional platform member having upper and lower surfaces and being further provided with a front to rear guide track disposed on said upper surface thereof;

said lower platform member being further provided with an analogous front-to-rear guide rail emanating downwardly from the lower surface thereof such that said front-to-rear guide rail may be slidably disposed within said front-to-rear guide track thereby enabling forward-backward manipulation of said lower platform member with respect to said first additional platform member.

13. The fixture of claim 12 including;

a second additional platform member juxatpositioned beneath said first additional platform member, said second additional platform member having upper and lower surfaces and being further provided with a side-to-side guide track disposed within said upper surface thereof;

said first additional platform member being additionally provided with a side-to-side guide rail emanating downwardly from said lower surface thereof such that said side-to-side guide rail may be slidably disposed within said side-to-side guide track, thereby enabling side-to-side manipulation of said first additional platform member with respect to said second additional platform member.

14. The fixture of claim 1 including a bracket for operatively mounting said fixture on a machine.

15. The fixture of claim 14 wherein said bracket comprises a metal member attached to said fixture at one end and attached to said machine at the opposite end.

16. The fixture of claim 14 wherein said machine is a rotary grinding machine.

17. The fixture of claim 1 wherein said workpiece a lathe tool.

18. A fixture for pivotal manipulation of a workpiece about a point, said fixture comprising:

an upper platform member having upper and lower surfaces, said upper platform member being provided with an arcuate guide rail attached to said lower surface thereof and a means for positioning a workpiece attached to said upper surface thereof;

a lower platform member having upper and lower surfaces, said lower platform member being provided with an arcuate guide track positioned on said upper surface thereof, said guide track being analogous in configuration to said guide rail;

said upper and lower platform members being closely juxtapositioned such that said arcuate guide rail is slidably disposed within said arcuate guide track, thereby permitting pivotal movement of said upper platform member with respect to said lower platform member; and a first additional platform member juxtapositioned beneath said lower platform member, said first additional platform member having upper and lower surfaces and being further provided with a front-to-read guide track disposed on said upper surface thereof;

said lower platform member being further provided with an analogous front-to-rear guide rail emanating downwardly from the lower surface thereof such that said front-to-rear guide rail may be slidably disposed within said front-to-rear guide track thereby enabling forward-backward manipulation of said lower platform member with respect to said first additional platform member.

19. A fixture for pivotal manipulation of a workpiece about a point, said fixture comprising:

an upper platform member having upper and lower surfaces, said upper platform member being provided with an arcuate guide rail attached to said lower surface thereof and a means for positioning a workpiece attached to said upper surface thereof;

a lower platform member having upper and lower surfaces, said lower platform member being provided with an arcuate guide track positioned on said upper surface thereof, said guide track being analogous in configuration to said guide rail;

said upper and lower platform members being closely juxtapositioned such that said arcuate guide rail is slidably disposed within said arcuate guide track, thereby permitting pivotal movement of said upper platform member with respect to said lower platform member;

a first additional platform member juxtapositioned beneath said lower platform member, said first additional platform member having upper and lower surfaces and being further provided with a front-to-rear guide track disposed on said upper surface thereof;

said lower platform member being further provided with an analogous front-to-rear guide rail emanating downwardly from the lower surface thereof such that said front-to-rear guide rail may be slidably disposed within said front-to-rear guide track thereby enabling forward-backward manipulation of said lower platform member with respect to said first additional platform member; and a second additional platform member juxtapositioned beneath said first additional platform member, said second additional platform member having upper and lower surfaces and being further provided with a side-to-side guide track disposed within said upper surface thereof;

said first additional platform member being additionally provided with a side-to-side guide rail emanating downwardly from said lower surface thereof such that said side-to-side guide rail may be slidably disposed within said side-to-side guide track, thereby enabling side-to-side manipulation of said first additional platform member with respect to said second additional platform member.

* * * * *